US007040043B2

(12) United States Patent
McMullin

(10) Patent No.: US 7,040,043 B2
(45) Date of Patent: May 9, 2006

(54) SHOE CLEAT

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 0 days.

(21) Appl. No.: 10/915,472

(22) Filed: Aug. 11, 2004

(65) Prior Publication Data

US 2005/0034334 A1 Feb. 17, 2005

Related U.S. Application Data

(60) Provisional application No. 60/493,815, filed on Aug. 11, 2003.

(51) Int. Cl.
*A43C 5/02* (2006.01)

(52) U.S. Cl. ..... 36/127; 36/134

(58) Field of Classification Search ..... 36/127, 36/134, 67 D

See application file for complete search history.

(56) References Cited

U.S. PATENT DOCUMENTS

| | | | |
|---|---|---|---|
| 39,575 | A | 8/1863 | Hyatt et al. |
| 180,578 | A | 8/1876 | Gansalus |
| 416,861 | A | 12/1889 | Scafe |
| 485,459 | A | 11/1892 | Crocker |
| 697,135 | A | 4/1902 | Dearing |
| 962,719 | A | 6/1910 | Pratt |
| 982,278 | A | 1/1911 | Kline |
| 1,093,358 | A | 4/1914 | Schroeder |
| 1,243,209 | A | 10/1917 | Park |
| 1,304,616 | A | 5/1919 | Smith |
| 1,355,827 | A | 10/1920 | Finneran |
| 1,422,716 | A | 7/1922 | Jones |
| 1,749,351 | A | 3/1930 | McQueen |
| 1,768,426 | A | 6/1930 | Stelzer |
| 1,827,514 | A | 10/1931 | Golden |
| 1,876,195 | A | 9/1932 | Youmans |
| 2,185,397 | A | 1/1940 | Birchfield |
| 2,213,289 | A | 9/1940 | Riddell |
| 2,223,794 | A | 12/1940 | Pierce et al. |
| 2,258,805 | A | 10/1941 | Phillips |

(Continued)

FOREIGN PATENT DOCUMENTS

| | | |
|---|---|---|
| AT | 109770 | 5/1928 |

(Continued)

OTHER PUBLICATIONS

Softspikes, Inc., Advertisement, *Golf Digest*, Dec. 1996, p. 149. Advertisement "Introducing Gripper Golf Cleats", Feb. 1997 Purkey, M., "The Spikeless Debate," Nov. 5, 1996. "#10 Soft Spikes," *Golf World*, p. 65, 1996 Annual Issue.

*Primary Examiner*—Ted Kavanaugh
(74) *Attorney, Agent, or Firm*—Edell, Shapiro & Finnan LLC

(57) ABSTRACT

An improved cleat for an athletic shoe provides for: enhanced strength and wear-resistance for the cleat traction element; and/or prevention of grass, mud and other debris from agglomerating and clogging the cleat. A resiliently flexible web is connected between adjacent traction elements to absorb the lateral and torsional forces tending to weaken the junctions between the cleat hub and the traction elements. The web is extended from the hub to prevent debris from entering the space between the shoe sole and the traction elements as well as between the traction elements themselves.

23 Claims, 3 Drawing Sheets

U.S. PATENT DOCUMENTS 2,276,887 A 3/1942 Smith
2,292,299 A 8/1942 Smith
2,336,632 A 12/1943 Park
2,423,753 A 7/1947 Brooks
2,491,596 A 12/1949 Zaleski et al.
2,740,208 A 4/1956 Dye
2,745,197 A 5/1956 Holt
2,758,396 A 8/1956 Edwards
2,774,151 A 12/1956 Dahlquist et al.
2,784,503 A 3/1957 Anderson
2,803,070 A 8/1957 Passidomo et al.
2,844,833 A 7/1958 Odermatt
2,895,235 A 7/1959 Melchiona
3,328,901 A 7/1967 Strickland
3,487,563 A 1/1970 Austin
3,512,275 A 5/1970 Leavitt
3,559,310 A 2/1971 Kiela
3,561,140 A 2/1971 Ludwig
3,583,082 A 6/1971 Jordan, Jr.
3,583,083 A 6/1971 Drew
3,656,245 A 4/1972 Wilsom
3,672,077 A 6/1972 Coles
3,747,238 A 7/1973 Jankauskas
3,766,670 A 10/1973 Nakajima
3,775,874 A 12/1973 Bonneville
3,818,617 A 6/1974 Dassler et al.
3,859,739 A 1/1975 Dassler
3,890,725 A 6/1975 Lea et al.
4,014,114 A 3/1977 Jordan et al.
4,118,878 A 10/1978 Semon
4,141,158 A 2/1979 Benseler et al.
4,180,923 A 1/1980 Dassler
4,205,466 A 6/1980 Collins
4,233,759 A 11/1980 Bente et al.
4,299,038 A 11/1981 Epple
4,309,376 A 1/1982 Ueno et al.
4,330,950 A 5/1982 Reddien
4,360,490 A 11/1982 Collins
4,366,632 A 1/1983 Bente
4,375,728 A 3/1983 Dassler
4,392,312 A 7/1983 Crowley et al.
4,492,047 A 1/1985 Arff
4,521,979 A 6/1985 Blaser
4,527,345 A 7/1985 Lopez
4,571,852 A 2/1986 Lamarche et al.
4,587,748 A 5/1986 Collins
4,633,600 A 1/1987 Dassler et al.
D288,262 S 2/1987 Yokoishi
4,648,187 A 3/1987 Dassler
4,689,901 A 9/1987 Ilenburg
4,723,366 A 2/1988 Hagger
4,727,661 A 3/1988 Kuhn
4,777,738 A 10/1988 Giese et al.
4,782,604 A 11/1988 Wen-Shown
4,833,796 A 5/1989 Flemming
4,837,949 A 6/1989 Dufour
4,885,851 A 12/1989 Peterson
5,029,405 A 7/1991 DeHaitre
5,033,211 A 7/1991 Latraverse et al.
D320,882 S 10/1991 Collins
5,065,534 A 11/1991 Colins
5,070,631 A 12/1991 Fenton
5,077,916 A 1/1992 Beneteau
D327,975 S 7/1992 Saito et al.
D341,479 S 11/1993 Saito et al.
D341,480 S 11/1993 Saito et al.
D341,704 S 11/1993 Saito et al.
D341,705 S 11/1993 Saito et al.
5,259,129 A 11/1993 Deacon et al.
D341,938 S 12/1993 Saito et al.
D342,151 S 12/1993 Saito et al.
D342,152 S 12/1993 Saito et al.
D342,373 S 12/1993 Saito et al.
5,321,901 A 6/1994 Kelly
5,367,793 A 11/1994 Deacon et al.
5,410,823 A 5/1995 Iyoob
5,426,873 A 6/1995 Savoie
5,452,526 A 9/1995 Collins
5,483,760 A 1/1996 Kataoka et al.
5,524,367 A 6/1996 Ferreira et al.
5,533,282 A 7/1996 Kataoka et al.
5,572,807 A 11/1996 Ketty et al.
5,623,774 A 4/1997 Abbey
D385,988 S 11/1997 McMullin
D387,548 S 12/1997 McMullin
D389,299 S 1/1998 McMullin
5,791,071 A 8/1998 Rosdail
5,794,367 A 8/1998 Carroll
D401,046 S 11/1998 McMullin
D404,192 S 1/1999 McMullin
5,860,228 A 1/1999 Bathum
5,887,371 A 3/1999 Curley, Jr.
D407,893 S 4/1999 McMullin
D408,122 S 4/1999 McMullin
5,901,472 A 5/1999 Adam
D415,340 S 10/1999 McMullin
D416,673 S * 11/1999 Menke ..... D2/962
5,974,700 A 11/1999 Kelly
5,996,260 A 12/1999 MacNeill
6,023,860 A 2/2000 McMullin
6,041,526 A 3/2000 Collins
6,052,923 A 4/2000 McMullin
6,094,843 A 8/2000 Curley, Jr.
D432,770 S 10/2000 Breault
D436,248 S * 1/2001 Peabody ..... D2/962
6,167,641 B1 1/2001 McMullin
D439,396 S 3/2001 Savoie
D439,733 S 4/2001 Savoie
6,248,278 B1 6/2001 Kelly
D455,896 S * 4/2002 Peabody ..... D2/962
D459,866 S 7/2002 Gan
D463,902 S 10/2002 Yang
D465,080 S * 11/2002 Newman ..... D2/962
D465,643 S 11/2002 Cho
D468,084 S 1/2003 Lin
D476,467 S 7/2003 Takamoto et al.
6,810,608 B1 11/2004 Kelly
6,823,613 B1 11/2004 Kelly et al.
6,834,445 B1 12/2004 McMullin
6,834,446 B1 12/2004 McMullin
2002/0078603 A1* 6/2002 Schmitt ..... 36/134
2003/0131502 A1* 7/2003 Terashima ..... 36/127
2004/0010944 A1* 1/2004 McMullin ..... 36/127

FOREIGN PATENT DOCUMENTS

CA 2231216 9/1998
CH 670 800 7/1989
DE 185659 6/1907
DE 156642 7/1939
DE 2529027 1/1977
DE 2540426 3/1977
DE 3438060 6/1985
DE 4316650 11/1993
EP 0 153 136 8/1985
EP 0 282 257 9/1988
EP 0 342 232 11/1989
EP 0363217 4/1990
EP 0 524 861 1/1993
FR 493748 8/1919
FR 807754 1/1937
FR 536202 4/1992
GB 2814 0/1914
GB 6877 0/1896

| | | |
|---|---|---|
| GB | 401979 | 11/1933 |
| GB | 1139239 | 1/1969 |
| GB | 1 263 960 | 2/1972 |
| GB | 1378461 | 12/1974 |
| GB | 1434282 | 5/1976 |
| GB | 2004731 | 4/1979 |
| GB | 1 564 903 | 4/1980 |
| GB | 2 053 658 | 2/1981 |
| GB | 1587382 | 4/1981 |
| GB | 2 160 146 | 12/1985 |
| GB | 2 163 037 | 2/1986 |
| GB | 2 191 079 | 12/1987 |
| GB | 2223394 | 4/1990 |
| GB | 2248762 | 4/1992 |
| GB | 2266223 | 10/1993 |
| GB | 2 298 563 | 9/1996 |
| GB | 2322787 | 9/1998 |
| IT | 467815 | 12/1951 |
| JP | 7-209 | 1/1995 |
| JP | 9-168405 | 6/1997 |
| WO | 91/03960 | 4/1991 |
| WO | 94/28750 | 12/1994 |
| WO | 97/18724 | 5/1997 |
| WO | 98/35575 | 8/1998 |
| WO | 01/54527 | 8/2001 |
| WO | 01/54528 | 8/2001 |

* cited by examiner

SHOE CLEAT

CROSS REFERENCE TO RELATED APPLICATIONS

This application claims priority from U.S. Provisional Patent Application Ser. No. 60/493,815, entitled "Shoe Cleat", filed Aug. 11, 2003. The disclosure of this provisional patent application is incorporated herein by reference in its entirety.

The present invention constitutes an improvement of the invention disclosed in my prior U.S. Pat. No. 6,023,860 (referred to herein as "my '860 patent"), the disclosure of which is incorporated herein in its entirety by this reference.

BACKGROUND OF THE INVENTION

1. Field of the Invention

The present invention pertains generally to cleats for use with athletic shoes worn on turf and other surfaces. In particular, the present invention pertains to a golf cleat that provides improved traction and stability while minimizing clogging of the cleat by agglomerated soil, mud and grass.

2. Discussion of the Related Art

In my aforesaid '860 patent there is disclosed a removable cleat for use with an athletic shoe for providing traction to a user on a turf surface without damaging the turf surface, and also providing traction on hard surfaces, carpeting and other flooring without damaging that flooring. That removable cleat comprises a hub having a first or upper side facing the shoe sole and a second or bottom side facing away from the shoe sole. A hub attachment means extends from the first side for attaching the hub to one of the plural attachment means located on or in the shoe sole. Plural traction elements extend in cantilevered fashion from the hub periphery, each traction element having a turf-engaging portion projecting away from the bottom side of the hub for engagement with turf blades to provide traction without puncturing turf. The traction element is resiliently deflectably attached to the hub so that the turf-engaging portion deflects toward the shoe sole when it encounters a hard surface under load, thereby minimizing wear of the turf-engaging portion of the traction element by the hard surface. The relatively broad and substantially flat outward surface of the traction element tends to trap grass blades against the sole of the shoe to enhance traction.

Although exceptionally effective for its intended purpose, the cleat disclosed in my '860 patent has a tendency to become clogged with grass blades and/or mud in the region between the hub and the traction elements and between the traction elements themselves. The clogging material, particularly grass blades which tend to wrap around the hub, limits the deflection range of the traction elements toward the shoe sole and thereby compromises the effectiveness of the cleat in providing traction. In addition, the traction elements are subject to wear and possible tearing at the point of connection to the hub due transverse bending forces applied to the traction elements in use. More specifically, during walking, as the wearer of the golf shoe pushes off rearwardly on his/her rear foot, frictional engagement of the distal end of the traction element against the ground causes that distal end to resist rearward movement. As a result, the traction elements nearest the sides (as opposed to the front or back) of the shoe sole bend laterally in a direction tangential to the hub as the hub is forced rearwardly or forwardly. Such repeated lateral bending tends to weaken the junction between the hub and traction element until eventually the traction element tears loose from the hub. Similarly, pivoting or turning of the shoe sole when under the weight of the wearer, results in similar lateral bending stresses in the front and back traction elements, with the ultimate weakening and tearing of the traction element. Such pivoting occurs, for example, during a golf swing as the golfer pushes off from his/her rear foot.

In addition, although the cleat in my '860 patent has been found to be extremely effective in providing traction, I have found the there is room for improvement. In particular, the substantially flat outer surface of the traction elements distributes over a relatively large area the applied force that traps grass blades against the shoe sole. As a consequence, the trapping or gripping force is distributed, and the trapping pressure along the trapped grass blade is relatively small. It is desirable to efficiently localize the applied force to increase the pressure and better grip the trapped grass blades.

OBJECTS AND SUMMARY OF THE INVENTION

Therefore, in light of the above, and for other reasons that become apparent when the invention is fully described, an object of the present invention is to provide an improved shoe cleat of the general type described in my '860 patent wherein traction efficiency is improved by minimizing clogging of the structure by grass or mud and by strengthening the traction elements of the cleat to resist tearing in response to lateral bending stress.

It is another object of the invention to provide an improved shoe cleat of the general type described in my '860 patent wherein additional structural support is provided to eliminate or limit lateral bending of the traction elements of the cleat.

Still another object of the invention is to provide an improved shoe cleat of the general type described in my '860 patent wherein clogging of the cleat with grass and/or mud between the traction elements and the cleat hub is substantially eliminated.

It is a further object of the invention to provide an improved shoe cleat of the general type described in my '860 patent wherein the outer surface of the traction elements is contoured to focus over a relatively small area the force that traps grass blades against the shoe sole when the traction elements deflect under load.

The aforesaid objects, and others that will be evident from the disclosure herein, are achieved individually and in combination, and it is not intended that the present invention be construed as requiring two or more of the objects to be combined unless required by the claims attached hereto.

In accordance with the present invention, a resilient web is provided between adjacent traction elements. Each web has a convex upper surface and a concave lower surface, the upper convex surface being configured such that its apex abuts or is very closely proximate the outsole of the shoe when unstressed. The webs, being disposed around the hub periphery between traction elements, prevent grass and/or mud from entering the region between the traction element and the hub. Preferably, the webs are molded as an integral part of the cleat and therefore are made of the same resiliently flexible material that permits the traction element to resiliently flex under the weight of the wearer of the shoe. The webs thus flex in response to laterally applied forces to absorb the lateral stresses that would otherwise tend to tear the traction elements from the hub. In addition, the simple presence of the webs, apart from their flexure capability, provides lateral structural support for the traction elements.

In addition, the outer surfaces of the traction elements are contoured to maximize the pressure that traps grass blades against the shoe sole upon deflection of the traction elements. In the preferred embodiment of the invention the outer surface of each traction element is formed of two outwardly converging generally planar sections that intersect at a linear edge, or at a narrow strip, along the length dimension and at the outermost part of the traction element. Alternatively, the outer surface can be multi-faceted with plural intersections that provide respective localized forces. A further alternative is to configure the outer surface of the traction element as a segment of an elipsoid or other shape extending lengthwise along the traction element such that only a small area of the surface traps the grass blades against the shoe sole.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
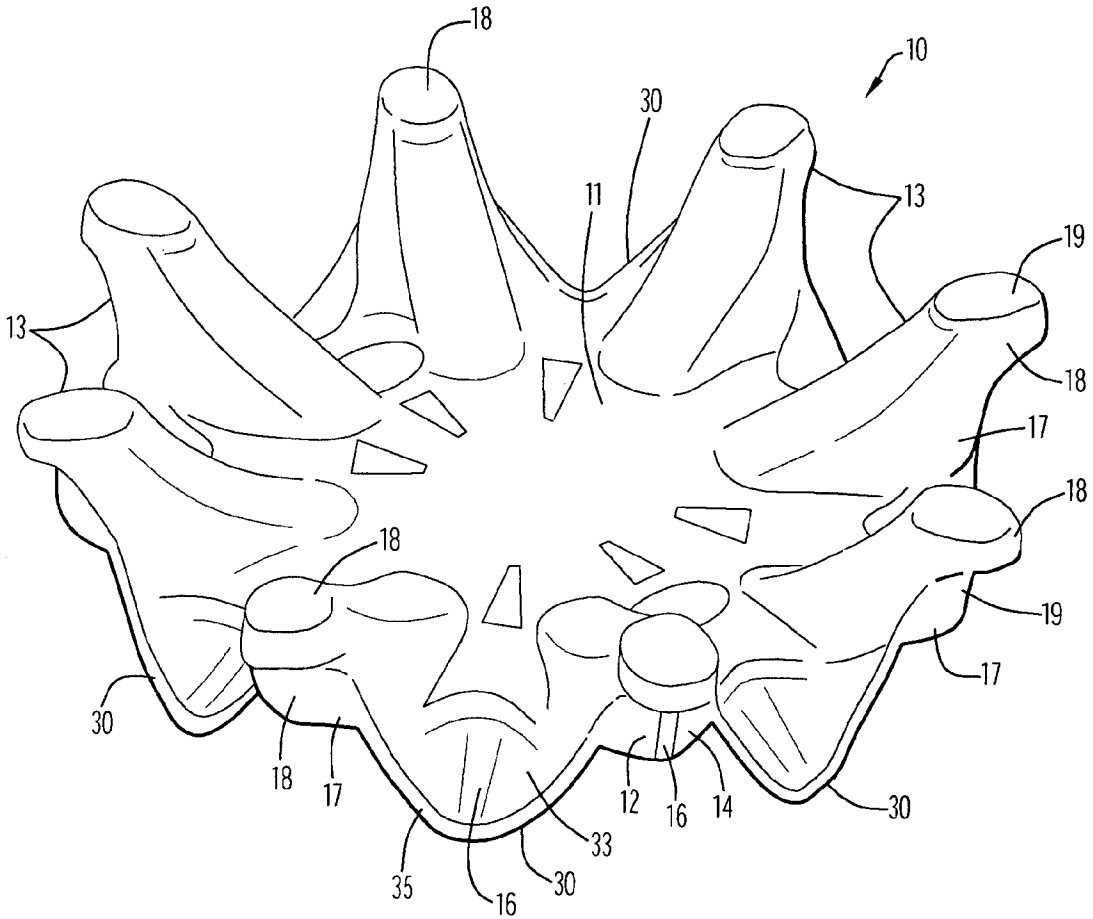
FIG. 1 is a view in perspective of the bottom or traction side of an exemplary shoe cleat in accordance with the present invention.
Figure 2:
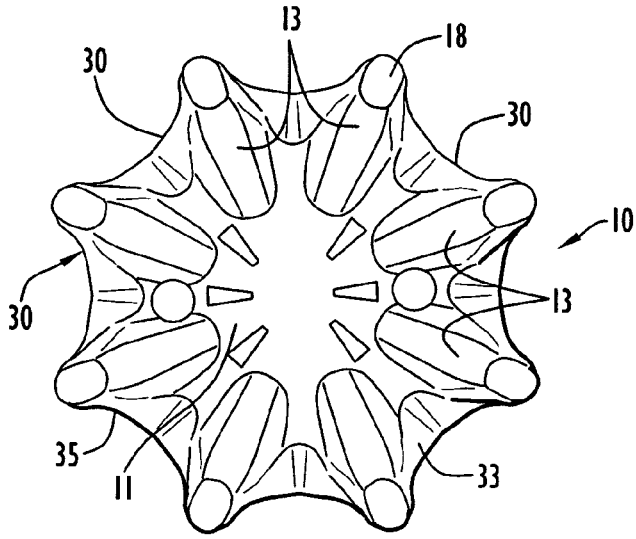
FIG. 2 is a bottom view in plan of the shoe cleat of FIG. 1.
Figure 3:
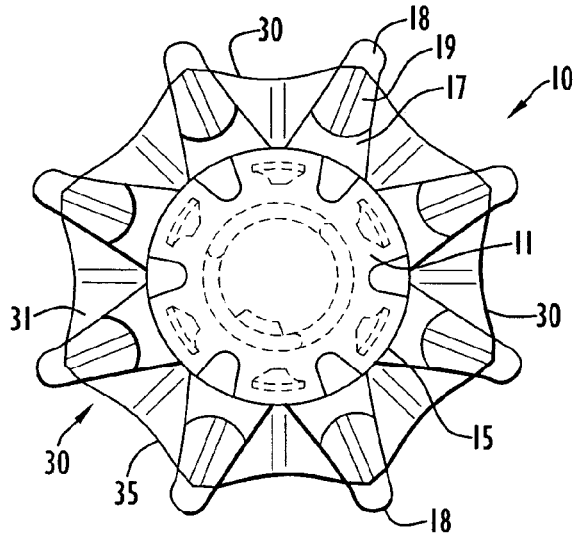
FIG. 3 is a top view in plan of the shoe cleat of FIG. 1.

In accordance with the present invention, traction is provided for athletic activities on turf surfaces by providing an athletic shoe having cleats, each of which has a hub with a plurality of traction elements extending outwardly and downwardly from the hub with resiliently flexible webs extending between and connecting adjacent traction elements. The cleat also preferably includes an attachment member, male or female, such as a threaded stud or shaft or socket or other attachment device which may be integral with, or removable from, the central hub, for attaching the cleat to a corresponding mating attachment member, such as a threaded or other engagement socket or shaft secured in the sole of an athletic shoe. Each traction element is strengthened against tearing by the connecting webs, and the webs are positioned and configured to prevent clogging of the cleat with grass and/or mud in the region between the traction elements and the cleat hub.

Referring to FIGS. 1–5, a cleat 10 has an attachment stud 20, or the like, which preferably is threaded for attachment to a shoe 50 via one of plural threaded sockets mounted in the shoe outsole or otherwise secured to the shoe in a conventional manner. The particular means for attaching the cleat to a shoe (i.e., the inter-engaging connection components on the cleat and shoe) are not part of the present invention. In that regard it is to be understood that any connection means can be used to connect the cleat of the present invention to a shoe. In addition, the connection means may include a locking mechanism to prevent inadvertent removal of the cleat from the socket. Further, the connection means may be indexable in the sense that the cleat can reside in the socket in only one rotational position. The indexable feature is particularly useful where the traction elements are configured and/or positioned asymmetrically to render the cleat most effective to provide traction when in a particular rotational position. Still further, the connection means may be male or female and adapted to engage a corresponding female or male structure, respectively, mounted in he shoe sole.

In addition to connector or stud 20, discussed above, each cleat 10 preferably has a generally planar hub 11 from the upper surface of which stud 20 extends generally perpendicularly. In the preferred embodiment illustrated in the drawings, hub 11 is substantially circular; however, the hub can have virtually any configuration. A plurality of spaced traction elements 13 project outwardly and downwardly from the periphery 15, or from close to the periphery, of hub 11. In the preferred embodiment there are eight traction elements which are angularly spaced at equal intervals along hub periphery 15. As shown in the drawings, each traction element 13 preferably includes a proximal arm 17 and a turf-engaging leg portion 19 which, in turn, terminates in a distal ground-engaging foot 18. It should be noted, however, that the traction elements need not be segmented into angularly oriented arm and leg portions but instead can be formed as a single straight section appropriately angled downwardly and outward from the hub. Traction elements 13 are preferably joined at their proximal ends deflectably to hub 11, in a cantilevered manner, so that traction elements 13 can resiliently deflect when their distal feet 18 encounter a hard surface (such as a paved surface or even a closely cropped golf green or other closely cropped grass surface) under the weight of the wearer of the shoe. Where, as in the preferred embodiment, the traction element 13 includes defined arm and leg segments, preferably at least the arm is resiliently deflectably mounted to hub 11. Most preferably, the entire traction element, but at least arm 17, is made from a resilient material such as polyurethane or other resiliently flexible elastomer. Turf-engaging leg portions 19 can be made from the same material as arms 17, provided that the material is sufficiently durable, or at least a portion such as foot 18, can be made from a more abrasion-resistant material such as a filled elastomer. When turf-engaging leg portions 19 are made from a different material than arms 17, leg portions 19 preferably are co-molded with arms 17. Similarly, hub 11 could be made from the same material as arms 17, or could be a different material. Preferably, however, cleat 10 is made entirely from a single material such as polyurethane or other flexible, durable elastomer, from which it is preferably made by injection molding.

The preferred traction elements 13 provide traction on turf by the inter-engagement of turf-engaging leg portions 19 with the individual grass blades without penetrating or puncturing the crown of any individual grass plant of the turf, and without penetrating or puncturing the soil. Turf-engaging portions 19 preferably extend down between the grass blades and preferably are restrained by the grass blades themselves against lateral motion, thereby providing traction. Because of the deflectable connection of traction elements 13, turf-engaging portions 19 can be allowed to protrude into the grass blades while nevertheless avoiding or minimizing damage to the turf.

Figure 4:
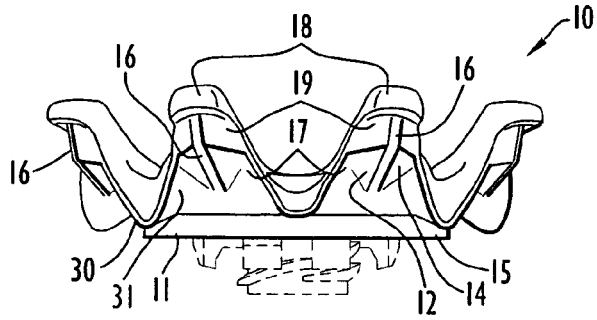
FIG. 4 is a side view in elevation of the shoe cleat of FIG. 1.
Figure 5:
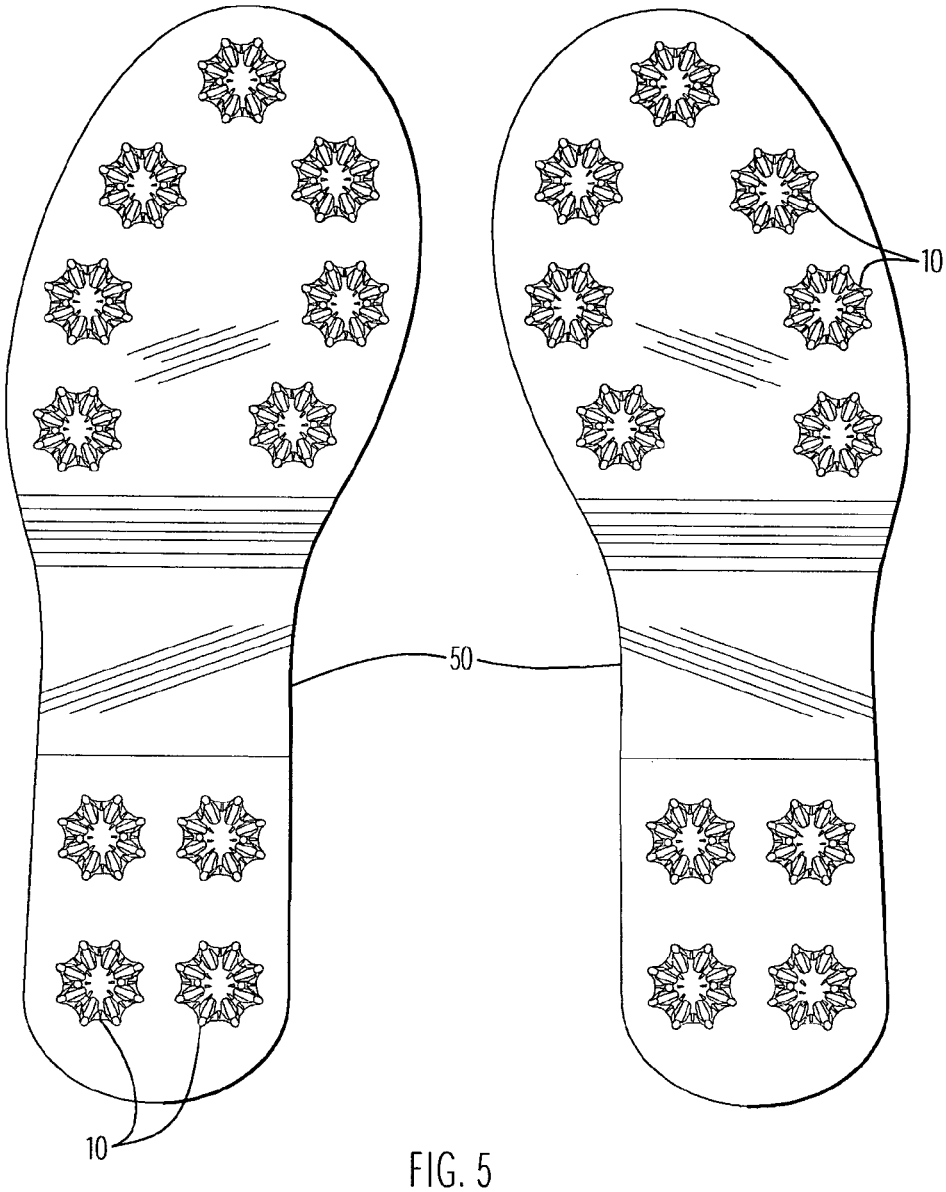
FIG. 5 is a bottom view in plan of a pair of shoes to which are secured a number of shoe cleats substantially similar to the shoe cleat of FIG. 1.

The cleat as thus far described is substantially similar to the cleat disclosed in my '860 patent. One of the features that sets the present invention apart is a series of webs 30 extending between successively adjacent traction elements 13. Each web has a convex generally upward (i.e., toward the shoe sole) facing surface 31 and a concave generally downward (i.e., toward the ground) facing surface 33. The outermost edge 35 of each web terminates radially inward of the outermost extension of its adjacent traction elements 13, and preferably slightly inward of the bend demarking the transition between the arms 17 and legs 19 of those traction elements. The curvature of upward facing surface 31 is such that at least the apex of the convex surface abuts or is very closely proximate the sole of the shoe on which the cleat is mounted when the cleat is not under load (i.e., when there is no weight forcing the traction elements into deflection). Stated otherwise, and as best illustrated in FIG. 4, the apex of surface 31 resides in or proximate the plane of hub 11. In this position, the webs serve to impede grass and debris against entering the region between the traction elements and the hub. In the absence of the web, grass and debris tend to enter and agglomerate in that region via the spaces between adjacent traction elements. In other words, the webs serve as means for preventing debris and grass from collecting between adjacent traction elements and between the traction elements and the hub.

Each web 30 preferably has a substantially uniform thickness throughout its area, the thickness and material being sufficient to render the web resiliently flexible. Therefore, when the cleat is under an increasing weight load, as the traction elements 13 deflect upwardly, the webs also deflect and widen or flatten to force more and more of the upper surface 31 against the sole of the shoe. The seal against grass and debris thereby increases as the weight load on the traction elements increases.

In addition to sealing against grass and debris as described, the webs 30 provide a lateral restraining force to prevent lateral and/or torsional displacement of traction elements 13 while permitting resilient vertical deflection of those elements without impediment. More particularly, the webs absorb the lateral and torsional forces that would otherwise tend to weaken the joint at which the traction elements are connected to the hub. In other words, the webs comprise means for reducing torsional and lateral stress forces applied to the traction elements. In this way the webs strengthen the traction elements against forces tending to tear the traction element away from one another and from the hub.

The web is preferably molded integrally with the remainder of the cleat as one unit. The particular configuration of the web shown in the preferred embodiment is a preferred configuration only and not limiting on the scope of the invention. Whatever the web configuration, the important point is that it must be able to block entry of debris into the region between the traction elements and the hub, and it must strengthen the traction elements against lateral and torsion forces that tend to damage or tear those elements. For example, in one alternative embodiment the apex of the upper surface of the web is linear, formed as the intersection of two curved or substantially planar surfaces. In another alternative embodiment, the apex, whether arcuate or linear, may diverge or extend slightly upward as a function of distance from the hub periphery. If the web is arcuate, the length of the arc has a practical limit of 180° (i.e., semicircular) in order to facilitate molding and to assure that the web expands angularly under load to permit the traction elements to deflect upwardly without being restrained by the web. In this regard, for any web configuration, even one that is not purely arcuate (e.g., a triangular or multi-faceted shape), the portions of the web that join adjacent traction elements should preferably be the portions having the greatest lateral spacing or separation on the web.

The web 30 must be thick enough (i.e., between the upper and lower surfaces) to provide the described stability to the traction elements and maintain the web shape. The web must be thin enough, given the material used, to a low the traction elements to resiliently deflect upwardly under load. The thickness is preferably uniform throughout the web, but the thickness dimension may taper as long as the above-described web functions (i.e., debris blockage and traction element support) are not impaired.

For a given spacing between adjacent traction elements, the arc of the web can be made shallower or deeper and still be effective to serve the sealing and traction element strengthening functions. Moreover, the webs may be configured to distally terminate either at or inward from the distal ends of the traction elements as the functional requirements for the cleat dictate.

It is to be understood that, for some applications, the debris blocking feature of the present invention may not be required but the lateral and torsional support for the traction elements is desirable. Under those circumstances the webs may be connected to and extend between adjacent traction elements but need not be connected to and extend from the hub. The shorter flexible strip or web still absorbs lateral and torsional forces that could damage the traction elements, but it does not provide a seal against the entry of debris between the shoe sole and the traction elements.

Although the preferred form of the traction element is the resilient element described above, the debris-blocking web of the present invention has applicability with other traction element configurations, irrespective of whether or not those elements flex or have resilience. By way of example, the debris-blocking web of the present invention may be employed between traction elements provided in cleats of the type disclosed in: U.S. Patent Application Publication No. 2003/0172556 (Terashima); U.S. Pat. No. 6,675,505 (Terashima); U.S. Pat. No. 6,530,162 (Carroll); U.S. Design Patent No. D468,895 (Savoie); Japanese published patent application no JP2001197907A2 (Japana); etc.

Another feature of the invention is the configuration of the outer surface of each traction element 13. Specifically, in the preferred embodiment, each outer surface is formed as two substantially planar sections 12, 14 intersecting at a linear edge or thin strip 16 extending longitudinally along arm 17 and leg 19 of the traction element. Edge or strip 16 constitutes the outermost part of each traction element and is the part of that element that contacts and traps grass blades against the shoe sole upon deflection of the traction element under load. This relatively narrow surface area thus focuses the applied force along a narrow pressure line so that the trapped grass blades are more tightly held. Although the vertically linear strip 16 formed by two converging or intersecting planar facets is the preferred embodiment for increasing the trapping pressure, it will be appreciated that other surface contours can be used to localize the trapping force and increase the pressure holding the trapped grass blades against the shoe sole. For example, two facets can intersect at a lineal edge that would serve as the trapping location; multiple facets may be provided and intersect at narrow strips or ridges; etc.

The preferred embodiment of the invention is a symmetrical cleat in which traction elements 13 are equally spaced about a circular hub. It will be appreciated, however, that the web and force focusing features of the invention individually apply to other types of cleats, including those in which the hub is asymmetrical and/or the traction elements are asymmetrically disposed. In particular, the hub may have any suitable geometric configuration consistent with the principles described herein, including, without limitation, irregularly shaped configurations, or regular circular, elliptical, rectangular, triangular or multi-sided configurations, etc. Likewise, the traction elements can be of different types on the same cleat and/or can be positioned asymmetrically to achieve desired traction functions.

As noted above, the means for attaching the cleat to a shoe, or a socket or a male connector in a shoe, does not constitute part of the invention in that any attachment and/or locking means can be utilized without departing from the principles of the invention.

Although it is preferred that the entire cleat be molded integrally from the same polymer material, it is within the scope of the invention to otherwise form the cleat such that separate parts are separately formed and later joined, and/or forming different parts of the cleat form different materials in order to optimize the intended functions of those parts.

The features of the invention apply most optimally when used with cleats in which the traction elements freely resiliently flex under load, as described. It should be noted that the principles nevertheless apply for other cleats. For example, whether or not the traction elements flex, an intervening web structure as described herein minimizes agglomeration of grass and debris between the traction elements and the shoe sole. If only a slight degree of flexure is permitted, the force focusing feature of the invention still is applicable. The selection of a specific cleat design, including a selected number of each type of traction element, as well as a selected orientation of the traction elements in sets on the hub, depends upon specific applications in which the cleat will be utilized and the type, amount and direction of traction that is desired for that application.

Although not specifically shown in the drawings, the bottom surface of the hub may be provided with a convex or otherwise raised portion to absorb most of the weight of the wearer of the shoe, particularly on hard surfaces, to minimize wear on the traction elements.

The cleat is preferably constructed of any one or more suitable plastic materials, including, without limitation, polycarbonates, polyamides (e.g., nylon), polyurethanes, natural or synthetic rubbers (e.g., styrene-butadiene), and other elastomeric polyolefins.

While the bottoms of feet 18 are depicted as being generally planar in the figures, it is noted that the feet may have other configurations, for example a rounded and slightly convex configuration, depending upon the particular application, so as to enhance deflection of elements 13 as they resiliently flex under the weight of the wearer of the cleated shoe against a ground surface.

The cleat may be removably or non-removably secured to the shoe sole. Any suitable cleat connector may be utilized to removably secure the cleat to the shoe in any selected orientation. The cleat connector may include a single connecting member or a series of connecting members that combine to secure the cleat to the shoe sole. It is to be understood that, when a cleat connector includes two or more connecting members, the central axis of the cleat connector is disposed at the geometric center defined by the combination of connecting members forming the cleat connector. Any number of cleats may be combined in any number of suitable orientations to provide enhanced traction for a particular user and/or a particular activity.

It will be understood that, although the features of the present invention have particular utility for cleats used with golf shoes, the principles of the invention apply to cleats used for any sport or purpose.

Having described preferred embodiments of shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat securable to the sole of a shoe for providing traction for the shoe on a ground surface, the cleat comprising:

a hub with an exposed bottom surface facing away from the shoe sole when the cleat is secured to the shoe;

a plurality of traction elements extending from the hub in a direction away from the exposed bottom surface of the hub;

a cleat connector member provided in an upper surface of the hub facing oppositely of the exposed bottom surface, wherein said connector is securable to a shoe connector member; and at least one resiliently flexible web having a distal edge extending radially outward from said hub and a convex generally upward facing surface disposed proximate the shoe sole, said web extending along and between at least two of said traction elements in a position to prevent debris and grass from collecting between the at least two traction elements and the sole of the shoe and to impart lateral support to said traction elements.

2. The cleat of claim 1, wherein said at least two of said traction elements are dynamic traction elements extending from the hub in a direction away from the exposed surface of the hub, the dynamic traction elements being configured to deflect toward the shoe sole when the shoe sole is forced against the ground surface; and wherein said web extends between and is connected to said at least two traction elements to resiliently flex and widen in response to the dynamic traction elements deflecting toward the shoe sole.

3. The cleat of claim 2 wherein each dynamic traction element includes an outer surface facing generally outward from said hub, and wherein said outer surface is contoured with an outermost segment having a much smaller area than the overall area of the outer surface to contact grass blades trapped between the traction element and the sole of the shoe when the traction element flexes upwardly toward the shoe sole.

4. The cleat of claim 1 wherein said convex surface faces oppositely of the exposed hub surface.

5. The cleat of claim 4 wherein said hub is generally planar and said convex surface includes an apex residing in or closely proximate the plane of said hub.

6. The cleat of claim 5 wherein said web is resiliently connected to said traction elements and is sufficiently flexibly resilient to permit it to laterally widen and thereby flatten said apex in response to forces applied to said traction elements.

7. The cleat of claim 1 including a plurality of said webs, each web extending from said hub and connected between a respective pair of said traction elements to prevent debris and grass from collecting between the respective pair of traction elements and the sole of the shoe and to impart lateral support to the respective pair of traction elements.

8. The cleat of claim 7, wherein said at least two of said traction elements are dynamic traction elements are adjacent one another and extend from the hub in a direction away from the exposed surface of the hub, the dynamic traction elements being configured to deflect toward the shoe sole when the shoe sole is forced against the ground surface; and wherein the web that extends between said at least two traction elements is sufficiently flexibly resilient to permit it to laterally widen and thereby flatten in response to forces applied to said traction elements.

9. The cleat of claim 7 wherein each web includes a convex surface facing upward, oppositely of the exposed hub surface.

10. The cleat of claim 9 wherein said hub is generally planar and said convex surface includes an apex residing in or closely proximate the plane of said hub.

11. The cleat of claim 10 wherein said apex contacts the shoe sole in response to the weight of a wearer of the shoe forcing said traction element downward.

12. The cleat of claim 11 wherein said hub, said traction elements and said webs are all components of an integrally molded single cleat unit.

13. The cleat of claim 9 wherein said convex surface is smoothly arcuate.

14. The cleat of claim 9 wherein apex of said convex surface is linear and formed as the intersection of two surfaces.

15. The cleat of claim 9 wherein said distal edge is disposed radially inward of the distal-most part of each of said respective pair of traction elements.

16. A cleat securable to the sole of a shoe for providing traction for the shoe on a ground surface, the cleat comprising:

a hub with an exposed bottom surface facing away from the shoe sole when the cleat is secured to the shoe;

a plurality of traction elements, each having a proximal end secured to said hub and a distal end extending from the hub in a direction away from the exposed bottom surface of the hub;

a cleat connector member provided in an upper surface of the hub facing oppositely of the exposed bottom surface, wherein said connector is securable to a shoe connector member;

means for preventing debris and grass from collecting between at least two adjacent ones of said traction elements and between those traction elements and the sole of the shoe; and wherein said means comprises at least one resiliently flexible web extending outwardly from said hub and connected between at least two adjacent ones of said traction elements.

17. The cleat of claim 16 wherein said web includes a convex surface facing upward, oppositely of the exposed hub surface, wherein said convex surface includes an apex residing in contact with or closely proximate the sole of the shoe when the web is unstressed.

18. A method of providing traction for a shoe on a ground surface utilizing a cleat secured to a sole of the shoe, the cleat including a hub with an exposed surface facing away from the shoe sole, a plurality of traction elements extending from the hub in a direction away from the hub exposed surface, and a cleat connector extending from a surface of the hub opposing the exposed surface, said method comprising the step of (a) preventing debris and grass from collecting between the traction elements and the sole of the shoe while imparting lateral support to said traction elements where step (a) includes extending a resiliently flexible web structure between adjacent traction elements, said resiliently flexible web structure having a convex generally upward facing surface disposed proximate the shoe sole.

19. An athletic shoe comprising:

a shoe sole having a plurality of sole connectors;

a plurality of cleats removably securable to the shoe sole for providing traction for the shoe on a ground surface, at least some of said cleats comprising:

a hub with an exposed bottom surface facing away from said sole when the cleat is secured to the shoe;

a plurality of traction elements extending from the hub in a direction away from the exposed bottom surface of the hub;

a cleat connector member provided in an upper surface of the hub facing said sole, wherein said cleat connector is securable to a respective sole connector;

at least one web extending outwardly between at least two of said traction elements and positioned to prevent debris and grass from collecting between the two traction elements and the sole of the shoe and to impart lateral support to said traction elements; and wherein said cleat includes a plurality of said webs, each web includes a convex surface facing toward said sole and each web extending from said hub and connected between a respective pair of said traction elements to prevent debris and grass from collecting between the respective pair of traction elements and the sole of the shoe and to impart lateral support to the respective pair of traction elements.

20. The cleat of claim 19, wherein said at least two of said traction elements are dynamic traction elements are adjacent one another and extend from the hub in a direction away from the exposed surface of the hub, the dynamic traction elements being configured to deflect toward said sole when said sole is forced against the ground surface; and wherein the web that extends between said at least two traction elements is sufficiently flexibly resilient to permit it to laterally widen and thereby flatten in response to forces applied to said traction elements.

21. The cleat of claim 19 wherein said hub is generally planar and said convex surface includes an apex contacting or closely proximate said shoe sole when the web is unstressed.

22. The cleat of claim 21 wherein said hub, said traction elements and said webs are all components of an integrally molded single cleat unit.

23. An athletic shoe comprising:

a shoe sole having a plurality of sole connectors;

a plurality of cleats removably securable to the shoe sole for providing traction for the shoe on a ground surface, at least some of said cleats comprising:

a hub with an exposed bottom surface facing away from the shoe sole when the cleat is secured to the shoe;

a plurality of traction elements, each having a proximal end secured to said hub and a distal end extending from the hub in a direction away from the exposed bottom surface of the hub;

a cleat connector member provided in an upper surface of the hub facing said shoe sole, wherein said connector is securable to a respective sole connector;

means for preventing debris and grass from collecting between at least two adjacent ones of said traction elements and between those traction elements and the sole of the shoe, said means comprising at least one resiliently flexible web extending outwardly from said hub and connected between at least two adjacent ones of said traction elements; and wherein said web includes a convex generally upwardly facing surface disposed proximate the shoe sole, wherein said convex surface includes an apex residing in contact with or closely proximate said sole when the web is unstressed.

* * * * *